United States Patent [19]

Trimarchi

[11] Patent Number: 4,982,748

[45] Date of Patent: Jan. 8, 1991

[54] METHOD FOR LENGTHENING NORMAL HAIR

[76] Inventor: Adriana L. Trimarchi, 18-02 A Corporal Kennedy St., Bayside, N.Y. 11360

[21] Appl. No.: 177,143

[22] Filed: Apr. 4, 1988

[51] Int. Cl.[5] ..... A41G 3/00; A41G 5/00

[52] U.S. Cl. ..... 132/201; 132/269; 219/225

[58] Field of Search ..... 132/53, 201, 269, 223; 219/222, 225; 57/202

[56] References Cited

U.S. PATENT DOCUMENTS

| | | | |
|---|---|---|---|
| 1,694,672 | 12/1928 | Rogler | 219/225 |
| 1,719,232 | 7/1929 | Meade | 219/225 |
| 1,794,574 | 3/1931 | Bertelsen et al. | 219/225 |
| 2,865,380 | 12/1958 | Mitchell | 132/53 |
| 3,835,868 | 9/1974 | Heck | 132/201 |
| 3,970,092 | 7/1976 | Nelson | 132/201 |
| 4,372,330 | 2/1983 | Nelson | 132/201 |

*Primary Examiner*—Kenneth J. Dorner
*Assistant Examiner*—J. Hakomaki
*Attorney, Agent, or Firm*—Lackenbach Siegel Marzullo & Aronson

[57] ABSTRACT

A method for lengthening of normal hair includes the preparation of filaments which match the color of the normal hair, the attachment of the filaments to the normal hair by braiding the filaments with portions of normal hair, wrapping the braids with portions of filaments and applying a heat hardenable sealer to the wrapped braid. Heat is applied to the wrapped braid using an apparatus which includes a pair of tip members which are adapted for mounting on the arms of a conventional heated curling iron. The tip members include pointed portions and opposing flat surfaces which facilitate the application of heat to limited and selected areas.

7 Claims, 4 Drawing Sheets

FIG. 1
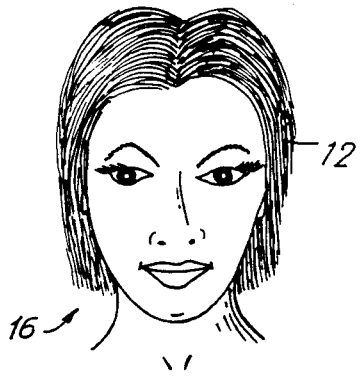
FIG. 2
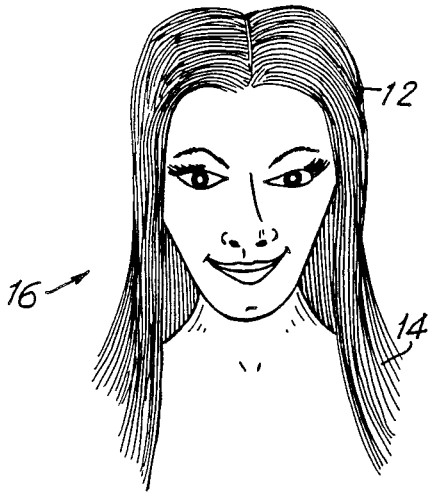
FIG. 3
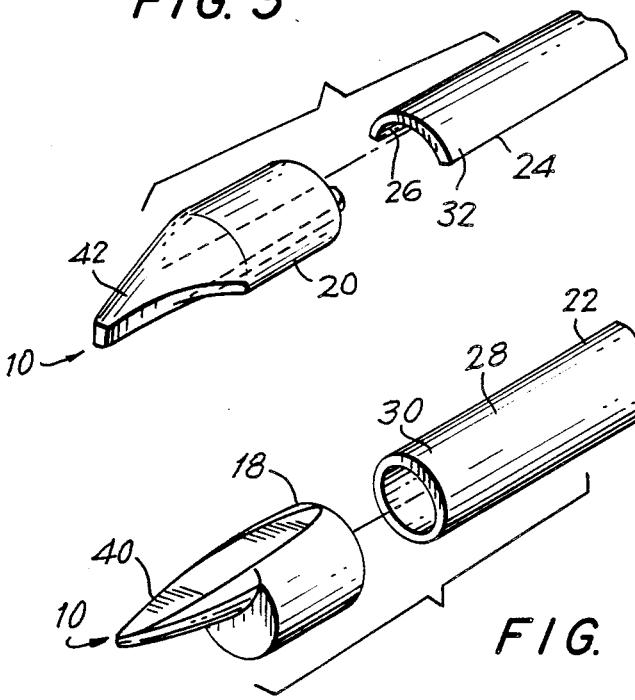
FIG. 4

FIG. 13
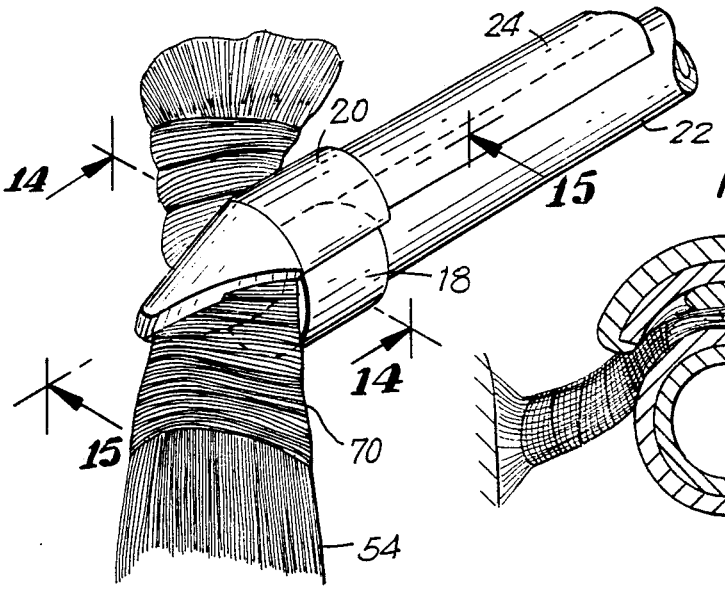
FIG. 14
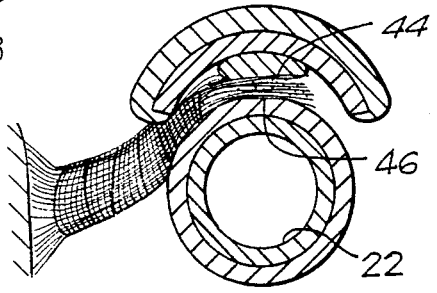
FIG. 15
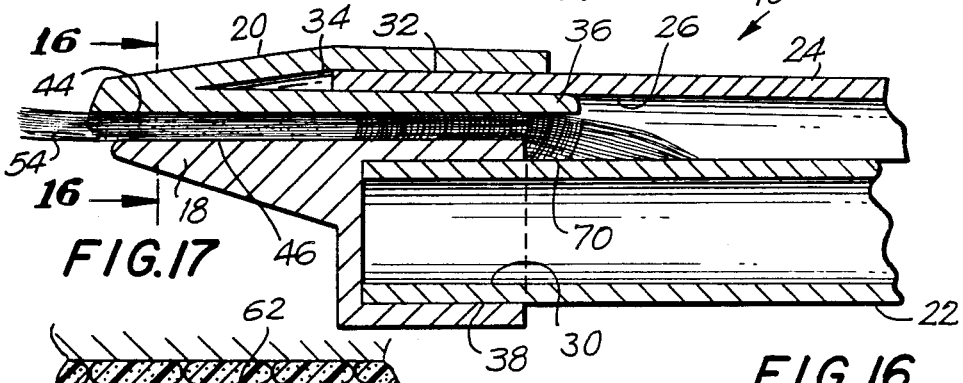
FIG. 17
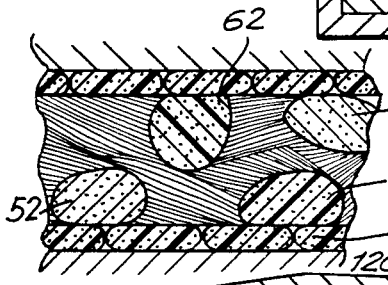
FIG. 16
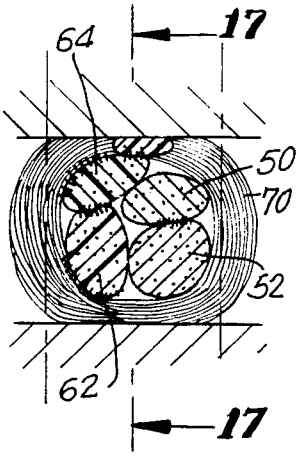
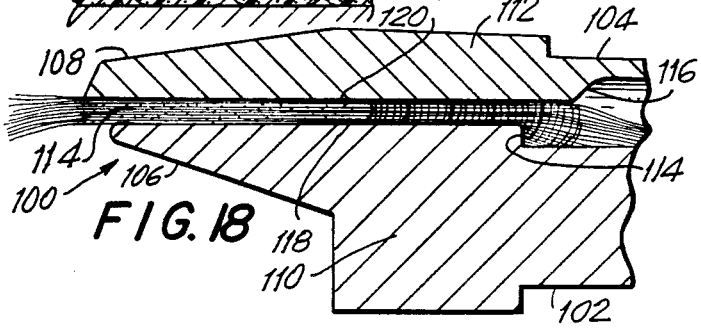
FIG. 18

METHOD FOR LENGTHENING NORMAL HAIR

BACKGROUND OF THE INVENTION

The conventional technique for augmenting the length and volume of a person's hair in order to improve the person's overall appearance is the application of a wig. Although the technology for the fabrication and application of wigs and hair pieces is relatively old and highly developed, the wearer of a wig always has the feeling and, to an extent, the appearance of wearing an artificial member or an appliance and never really benefits from the feeling of having long natural hair. This deficiency is a result of the numerous disadvantages of conventional wigs and hair pieces such as the inability to wear them while bathing and the need to remove them periodically to rest the scalp and to clean and repair them.

SUMMARY OF THE INVENTION

The present invention overcomes the disadvantages of conventional wigs and hair pieces and provides an apparatus and method for the lengthening of normal or natural hair. The invention provides a means for the semi-permanent attachment of filaments of synthetic hair to sections of natural hair through the ordered sectioning of the natural hair and the intertwining or braiding of the natural and synthetic hair followed by wrapping the braided portion of natural and synthetic hair with a portion of synthetic hair, applying a sealer and then applying heat to the wrapped layer of synthetic hair. The heat causes the sealer, which has penetrated the braid, to change from a liquid to a semisolid.

The heat is applied using the apparatus, according to the present invention, which comprises a pair of shaped jaws which fit over the ends of a conventional heated curling iron. The jaws include opposing flat portions which facilitate conveniently applying heat to a small selected area. The heat is applied only to the wrapped layer of synthetic hair and not to the natural hair thereby preventing damage to the natural hair.

OBJECTS OF THE INVENTION

It is an object of the present invention to provide an apparatus for the lengthening of normal hair through the use of synthetic hair.

Another object of the present invention is to provide a method for the lengthening of normal hair through the use of synthetic hair.

Another object of the present invention is to provide a method for the lengthening of normal hair which may be easily applied and easily removed without damaging the normal hair.

Another object of the present invention is to provide a method for the lengthening of normal hair which provides the appearance of longer hair and which can be applied and utilized for an extended period of time.

Still another object of the present invention is to provide an apparatus for lengthening normal hair which is relatively simple and economical to manufacture.

BRIEF DESCRIPTION OF THE DRAWINGS

Additional objects and advantages of the invention will become apparent during the course of the following specification when taken in connection with the accompanying drawings in which:

FIG. 1 is a front view of a woman's head prior to the application of the apparatus and method for effectuating the lengthening of normal hair through the use of synthetic hair, according to the present invention;

FIG. 2 is a view similar to FIG. 1 showing the woman's head after the application of the apparatus and method according to the present invention;

FIG. 3 is a fragmentary exploded view of a first portion of the apparatus according to the present invention;

FIG. 4 is a fragmentary exploded view of a second portion of the apparatus according to the present invention;

FIG. 13 is a fragmentary perspective view showing the operation of the apparatus of FIGS. 3 and 4;

FIG. 14 is a cross-sectional view taken along the line 14—14 of FIG. 13;

FIG. 15 is a cross-sectional view taken along line 15—15 of FIG. 13;

FIG. 16 is a cross-sectional view taken along the 15—15 of FIG. 15;

FIG. 17 is cross-sectional view taken along the line 17—17 of FIG. 16 and FIG. 18 is a fragmentary cross-sectional view of an alternative embodiment of the apparatus according to the present invention.

DETAILED DESCRIPTION OF THE INVENTION

Figure 5:
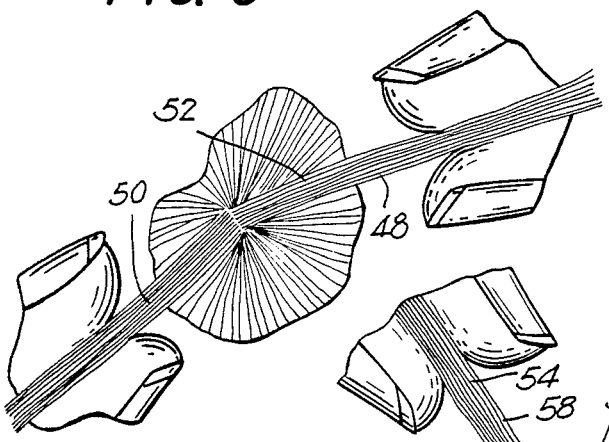
FIG. 5 is a fragmentary perspective view showing the first step in the application of the method for effectuating the lengthening of normal hair through use of synthetic hair, according to the invention.

With reference to the drawings, there is shown in FIGS. 1 and 2 the results of the application of the apparatus 10 and method for effectuating the lengthening of normal or natual hair 12 through the use of synthetic hair 14 according to the present invention. FIG. 1 shows a front view of a woman's head 16 prior to the application of the apparatus 10 and method of the present invention, and FIG. 2 shows the woman's head 16 after lengthening of the woman's hair 12 has been completed.

As is shown in FIGS. 1 and 2, the present invention accomplishes the lengthening of the woman's relatively short normal hair 12, FIG. 1, resulting in the appearance of long and luxuriant hair shown in FIG. 2. FIGS. 3 and 4 show the apparatus 10, according to the present invention, which comprises a pair of jaw members 18,20 which are adapted for mounting on the arm members 22,24 of a conventional curling iron. The curling iron is completely conventional in nature and therefore need not be shown or described in detail other than to indicate that the curling iron comprises a first arm member 22 which has a hollow cylindrical configuration and a second arm member 24 which has the overall configuration of a portion of a hollow cylinder. The arm member 24 has a curved surface 26 which matches the curved surface 28 of the arm member 22 and the curling iron has a means for supplying heat to the members 22,24, which is not shown. As is shown. is shown in FIGS. 3,4,14 and 15, the jaw members 18,20 are mounted on the ends 30,32 of the arm members 22,24, respectively. The jaw member 20 has a recessed portion 34 which fits over surface 32 of the end 30 of the arm member 24 and a projecting member or clip 36 which fits under the surface 26 of the arm member 24. The jaw member 18 has a bore 38 which fits onto the end 30 of the cylindrical member 22. The front portions 40,42 of each of the jaw members 18,20 taper to a blunt point and opposing surfaces of the jaw members 18,20 each have a flat portion 44,46, as is best shown in FIGS. 14 and 15. The jaw members 18,20 are made of a heat conducting material such as metal thereby facilitating the application of heat to a selected area in a controlled manner.

Figure 6:
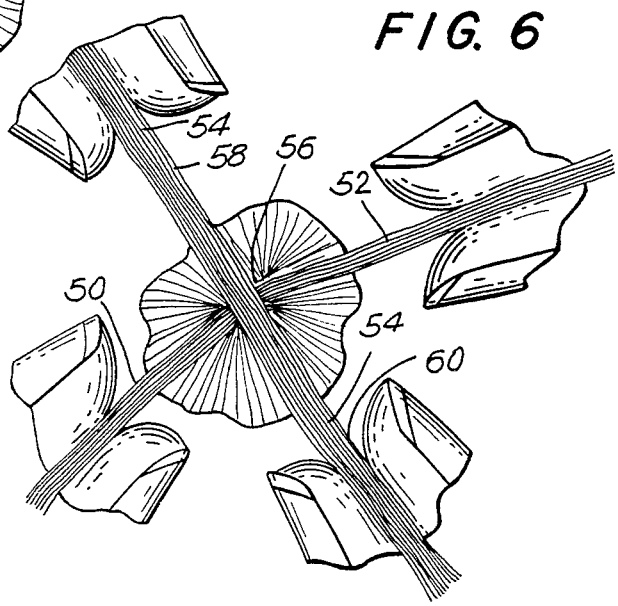
FIGS. 6, 7, 8, 9, 10, 11 and 12 are each fragmentary perspective views similar to FIG. 5 showing sequential steps in the application of the method for lengthening normal hair according to the present invention.
Figure 7:
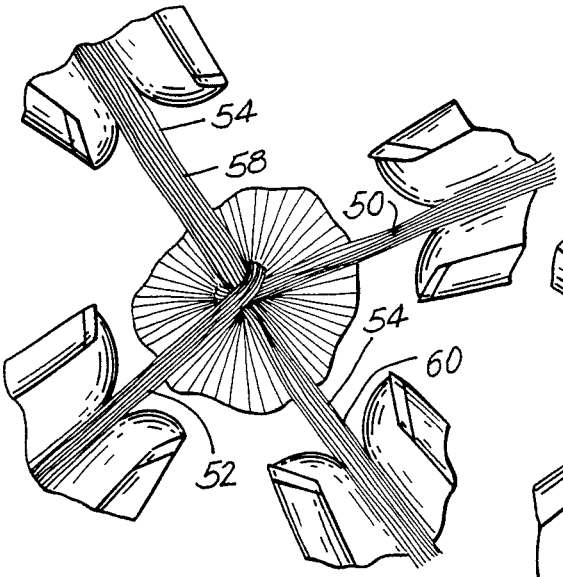
Figure 8:
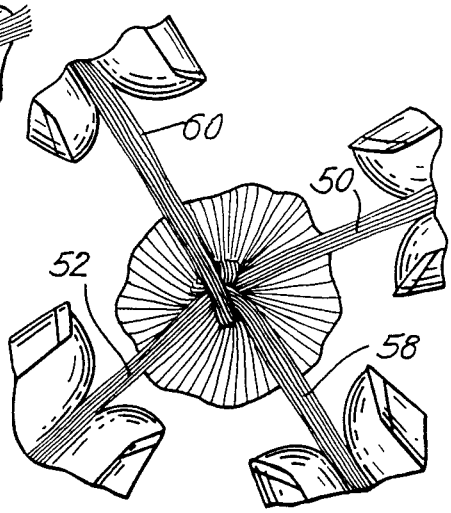
Figure 9:
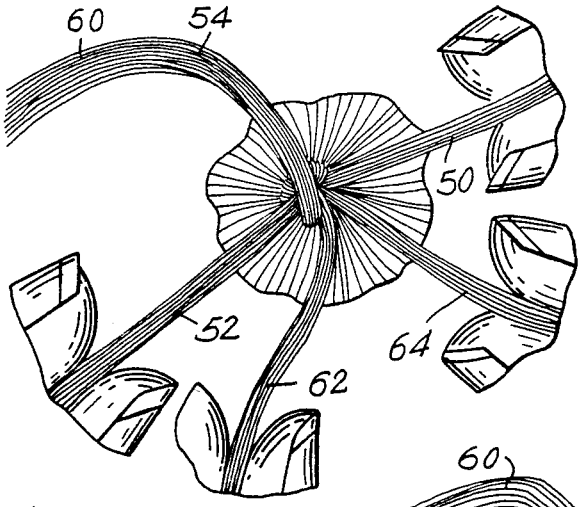
Figure 10:
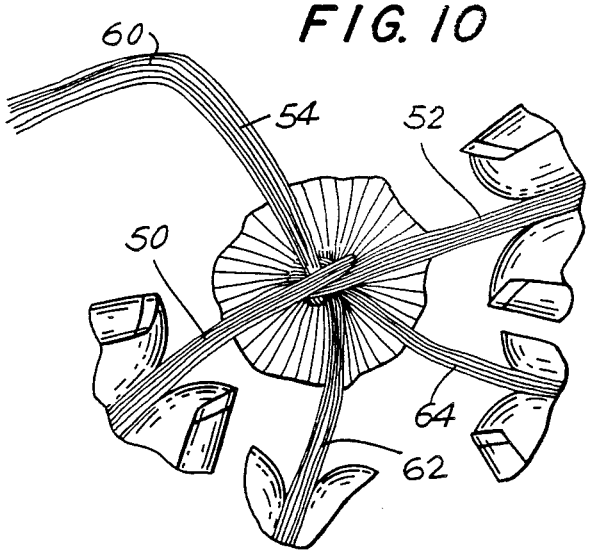

The first step in the application of the method according to the present invention is shown in FIG. 5 and comprises the sectioning of a small portion of normal hair 48 and dividing the section into two parts 50,52. FIG. 6 shows the next step in which a bundle of filaments 54, which has been previously matched to the color of the normal hair, is placed along the division 56 between the two parts 50,52 of normal hair. In FIG. 7 the normal hair 50,52 is crossed over the filaments 54. For the purpose of clarity of description, the filaments 54 are defined as having a first portion 58 and a second portion 60. In FIG. 8 the filament portions 58,60 are crossed over the normal hair 50,52. In FIGS. 9 and 10 the normal hair 50,52 is again crossed over the filament portions 58,60. In FIG. 10, the normal hair 50,52 is held with a moderate degree of tension. The top portion 60 of the filaments 54 is released by the operator and the bottom portion of the filament 58 is split into two portions 62,64. The portions 62,64 are crossed over each other, in turn, as previously described to achieve a four-piece braid 66, as is shown in FIG. 11.

Figure 11:
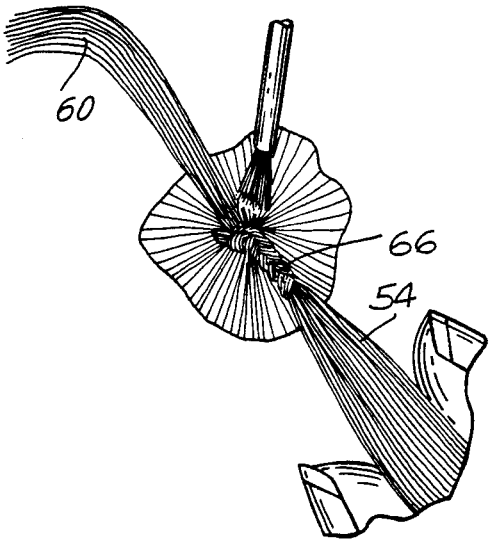

At this time, liquid sealer, which is one of the novel features of the present invention, is applied to the base portion 68 of the four-piece braid 66 as is shown in FIG. 11. The liquid sealer is in the nature of a thermally hardenable material or thermosetting resin. The liquid sealer seeps through the braid thoroughly coating the filaments 54 and the normal hair 48.

Figure 12:
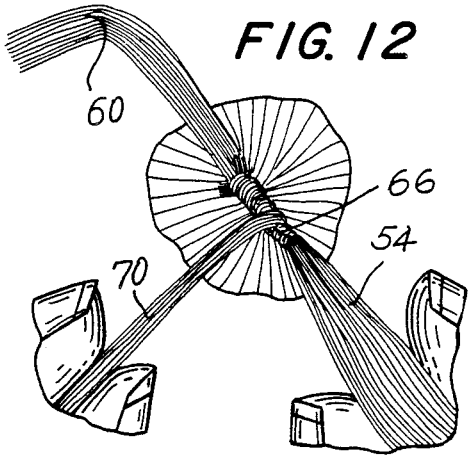

As is shown in FIG. 12 a small section 70 of the top portion of filament 60, which was previously released by the operator, is picked up and wrapped around the four-piece braid 66. The braid 66 is wrapped to a length of approximately one-half inch. At this time heat is applied to the top and bottom of the braid 66 using the jaw members 18,20 as is shown in FIGS. 13–17. The pointed shape of the jaw members 18,20 facilitate the application of heat to a limited and selected area. The heat is applied to both side of the wrapped filament 70 and transforms the liquid sealer to a semi-solid cohesive mass.

The heat is applied to the wrapped layer of filament 70 and not to the normal or natural hair 54. The heat is thus conducted to the sealer and the natural hair 54 is not exposed to potentially damaging heat.

The above process is repeated on additional portions of the head in order to add the desired amount of added hair. It is usually desirable to place the hair extensions in alternate rows on the head.

The hair extensions according to the present invention may be subjected to bathing and showering in the normal manner and may be cleaned while showering. The hair extensions may be worn continuously for average periods of three months depending on the degree of care that is practiced. In order to remove the hair extensions the sealed part of the braid 66 is broken with the fingers and the hair 42 and the filaments 54 are gently unravelled. Traces of sealer may be removed with remover if necessary.

In the alternative embodiment 100 of the invention, shown in FIG. 18, the jaw members 18,20 which were previously shown and described in connection with FIGS. 3 and 4 and the arm members 22,24 of the conventional curling iron, also shown in FIGS. 3 and 4 are configured as unitary members 102,104. The members 102,104 combine the functions of the arm members 22,24 and the jaw members 18,20 and are pivotally connected to a conventional source of heat which may be in the nature of an electrical resistance heater. The members 102,104 form the arms of an apparatus which is similar to a conventional curling iron. The apparatus differs from a conventional curling iron only in the configuration of the tips 106,1087. For this reason, only the tips 106,108 have been illustrated. The tips are similar to the jaw members 18,20 with the exception that the tip members 106,108 have a solid portion 110,112. In a manner similar to that shown in FIG. 15, the members 102,104 have step portions 114,116. These step portions 114,116 facilitate the application of heat only along the surfaces 118,120 in a controlled manner. In FIG. 18 the apparatus 100 is shown in use, applying heat to the wrapped braid portion 114.

While a preferred embodiment of the invention has been shown and described herein, it is obvious that numerous additions, changes and omissions may be made in such embodiments without departing from the spirit and scope of the invention.

What is claimed is:

1. A method for the lengthening of normal hair comprising the steps of:
   - preparing a supply of filaments matching the color of said normal hair,
   - forming said normal hair into a small section, dividing said section into two parts,
   - placing said filaments along said division between said parts of normal hair,
   - crossing said normal hair over said filaments,
   - crossing said filaments over said normal hair,
   - crossing said normal hair over said filaments,
   - releasing a portion of said filaments,
   - splitting the remaining portion of filaments into two portions,
   - braiding said two portions of filaments and said two portions of normal hair to form a four-piece braid,
   - applying a thermally hardenable sealer to the portion of said braid closest to the scalp,
   - selecting a small portion of said released portion of filament,
   - wrapping said selected portion filament around said four-piece braid,
   - applying heat to said wrapped four-piece braid thereby causing said sealer to harden,
   - engaging said wrapped four-piece braid between heated opposing jaws of a heating means, and bringing said heated jaws to bear on said wrapped four-piece braids.

2. A method for the lengthening of normal hair according to claim 1 further comprising the steps of repeating said steps of claim 1 to additional portions of normal hair.

3. A method for the lengthening of normal hair according to claim 1 further comprising the steps of
   - removing said filaments by breaking said hardened sealer portion and
   - unwinding said filaments from said normal hair.

4. A method for lengthening of normal hair according to claim 1 in which said step of applying heat further comprises applying heat to only the portion of said wrapped four-piece braid which is closest to the scalp.

5. A method the lengthening of normal hair according to claim 1 in which said step of wrapping said braided portion further comprises wrapping said selected portion of filaments around said four-piece braid to a length in the order of one-half inch.

6. A method for the lengthening of normal hair according to claim 1 in which said step of applying heat to said wrapped four-piece braid further comprises the step of applying heat to opposite surfaces of said four-piece braid.

7. A method for the lengthening of normal hair according to claim 6 in which said step of applying heat to said wrapped four-piece braid further comprises the step of simultaneously applying heat to opposite surfaces of said four-piece braid.

* * * * *